US010637162B2

(12) United States Patent
Nabeta

(10) Patent No.: US 10,637,162 B2
(45) Date of Patent: Apr. 28, 2020

(54) CONNECTION STRUCTURE OF THE ELECTRIC-WIRE AND THE TERMINAL

(71) Applicant: Yazaki Corporation, Tokyo (JP)

(72) Inventor: Yasunori Nabeta, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/460,370

(22) Filed: Jul. 2, 2019

(65) Prior Publication Data

US 2020/0014125 A1 Jan. 9, 2020

(30) Foreign Application Priority Data

Jul. 6, 2018 (JP) ..... 2018-128696

(51) Int. Cl.
*H01R 4/16* (2006.01)

(52) U.S. Cl.
CPC ..... *H01R 4/16* (2013.01)

(58) Field of Classification Search
CPC ..... H01R 4/24; H01R 4/38; H01R 4/00
USPC ..... 439/877, 422
See application file for complete search history.

(56) References Cited

U.S. PATENT DOCUMENTS 3,594,704 A * 7/1971 Fischer ..... H01R 4/2495 439/421
3,697,926 A * 10/1972 Krafthefer ..... H01R 12/716 439/75
3,852,702 A * 12/1974 Dowling ..... H01R 4/26 439/409
3,914,004 A * 10/1975 Bone ..... H01R 4/2491 439/393
4,494,029 A * 1/1985 Hoshino ..... H01R 39/39 310/239
4,555,155 A * 11/1985 Drake ..... A61B 5/0416 439/492
4,560,224 A * 12/1985 Weisenburger ..... H01R 4/2495 439/422
4,875,876 A * 10/1989 O'Loughlin ..... H01R 4/38 439/431
4,948,382 A * 8/1990 Marpoe, Jr. ..... H01R 4/2466 439/397
5,864,090 A * 1/1999 Wright ..... H01R 9/053 174/40 CC (Continued)

FOREIGN PATENT DOCUMENTS

JP 2008-226671 A 9/2008

*Primary Examiner* — Alexander Gilman
(74) *Attorney, Agent, or Firm* — Sughrue Mion, PLLC

(57) ABSTRACT

A connection structure of an electric wire and a terminal includes a terminal formed by folding back a base plate to form a body part and an elastic connection piece, and an electric wire having a core wire exposed from an insulation sheath. The elastic connection piece includes a first elastic connection part adjacent to a folded-back portion of the base plate and a second elastic connection part continuing to the first elastic connection part in the longitudinal direction of the base plate. An electric wire insertion hole is formed on each of the elastic connection parts. The core wire is sandwiched and connected by the elastic connection piece and the body part at a position between the first elastic connection part and the second elastic connection part at a state where the core wire is inserted through the wire insertion holes in the longitudinal direction of the base plate.

5 Claims, 5 Drawing Sheets

(56) References Cited

U.S. PATENT DOCUMENTS

| | | | | |
|---|---|---|---|---|
| 6,350,145 | B1 * | 2/2002 | Chen | H01R 4/2495 439/422 |
| 6,375,492 | B1 * | 4/2002 | Hio | H01R 12/68 439/422 |
| 7,316,581 | B2 * | 1/2008 | Kumakura | H01R 4/182 439/422 |
| 7,338,310 | B2 * | 3/2008 | Kumakura | H01R 12/67 439/422 |
| 7,462,062 | B2 * | 12/2008 | Kumakura | H01R 4/182 439/422 |
| 7,470,143 | B2 * | 12/2008 | Osborn, Jr. | H01R 11/05 439/438 |
| 7,618,279 | B1 * | 11/2009 | Osborn, Jr. | H01R 4/4818 439/441 |
| 7,650,914 | B2 * | 1/2010 | Bogursky | H01R 4/188 140/105 |
| 7,967,649 | B2 * | 6/2011 | Richter | H01R 4/183 174/84 C |
| 8,672,704 | B2 * | 3/2014 | de Bruijn | H01R 12/68 439/422 |
| 8,702,443 | B2 * | 4/2014 | Kajiura | H01R 12/68 439/422 |
| 8,911,269 | B2 * | 12/2014 | Takayama | H01R 4/203 439/421 |
| 8,993,890 | B2 * | 3/2015 | Sato | H01R 43/16 174/113 R |
| 9,054,430 | B2 * | 6/2015 | Sakamoto | H01R 4/16 |
| 9,935,382 | B2 * | 4/2018 | Okura | F21V 23/002 |
| 9,960,504 | B2 * | 5/2018 | Hikosaka | H01R 9/0518 |

* cited by examiner

CONNECTION STRUCTURE OF THE ELECTRIC-WIRE AND THE TERMINAL

CROSS REFERENCE TO RELATED APPLICATION

This application is based upon and claims the benefit of priority from the prior Japanese Patent Application No. 2018-128696, filed on Jul. 6, 2018, the entire contents of which is incorporated herein by reference.

BACKGROUND

Technical Field

The disclosure relates to a connection structure of the electric-wire and the terminal including a core wire with extra-fine strands.

Related Art

A related connection structure of the electric-wire and the terminal is described in JP 2008-226671 A. The connection structure of the electric-wire and the terminal described in JP 2008-226671 A includes a terminal, which includes a terminal connection part configured to be connected to a mating terminal and an electric-wire connection part connected to an electric-wire, and an electric wire having an extra-fine core wire exposed from an insulation sheath.

The insulation sheath of the electric-wire is crimped to an insulation barrel of the electric-wire connection part and the extra-fine core wire is crimped to a wire barrel on longitudinal direction of the electric-wire connection part of the terminal.

In the related connection structure of the electric-wire and the terminal, since a tip end of the wire barrel are crimped so as the tip end to be stuck into the core wire of the electric-wire by a crimping mold, when strands of the core wire are extra-fine, the core wire may be broken by the tip end. Moreover, a size of the connection structure of the electric-wire and the terminal is limited by the dimensions of the crimping die including a crimper, an anvil, etc., it cannot cope with narrow pitch connectors.

SUMMARY

The present embodiment discloses a connection structure of the electric-wire and the terminal that can easily and securely connect the electric-wire and the terminal without breaking the core wire of the electric-wire and can cope with narrow pitch connectors.

A connection structure of an electric-wire and a terminal according to an embodiment includes a terminal with a base plate, the base plate including a body part and an elastic connection piece formed by folding back the base plate in the longitudinal direction of the base plate, and an electric-wire having a core wire exposed from an insulation sheath. The elastic connection piece of the terminal includes a first elastic connection part adjacent to a folded-back portion of the base plate at one end and inclined toward the other end with respect to the body part of the base plate, and a second elastic connection part continuing to the first elastic connection part at one end and inclined toward the other end so as to face the first elastic connection part in the longitudinal direction of the base plate. A first wire insertion hole is formed on the first elastic connection part and a second wire insertion hole is formed on the second elastic connection part. The core wire exposed from the insulation sheath is sandwiched by the elastic connection piece and the body part and connected to the terminal at a position between the first elastic connection part and the second elastic connection part at a state where the core wire exposed from the insulation sheath is inserted through the first wire insertion hole and the second wire insertion hole in the longitudinal direction of the base plate, and the connection structure being formed by pressing the first elastic connection part and the second elastic connection part in a direction reducing the inclination of both the first elastic connection part and the second elastic connection part with respect to the base plate.

According to the above configuration, the connection structure of the electric-wire and the terminal can easily and securely connect the electric-wire and the terminal without breaking the core wire of the electric-wire and can cope with narrow pitch connectors.

DETAILED DESCRIPTION

Figure 1A:
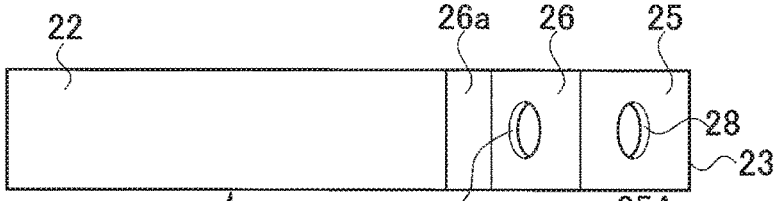
FIG. 1A is a plan view illustrating a terminal for a connection structure of an electric-wire and the terminal according to a first embodiment before connected to the electric-wire.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be herein below provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 1B:
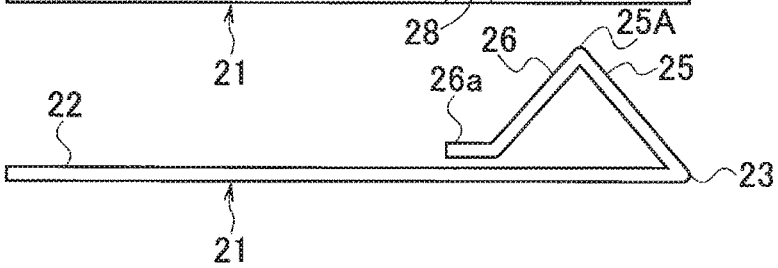
FIG. 1B is a side view of the state illustrated in FIG. 1A.
Figure 2A:
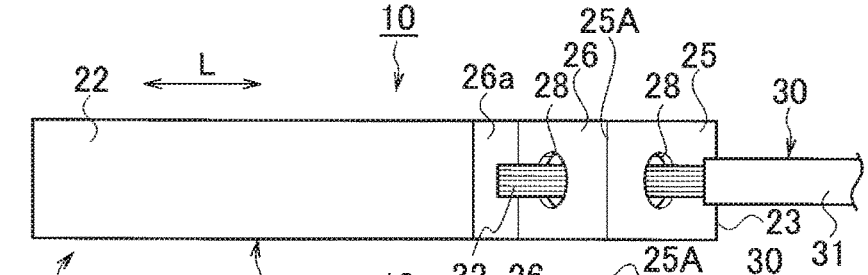
FIG. 2A is a plan view illustrating a state that the electric-wire being arranged to the terminal of the connection structure of the electric-wire and the terminal according to the first embodiment.
Figure 2B:
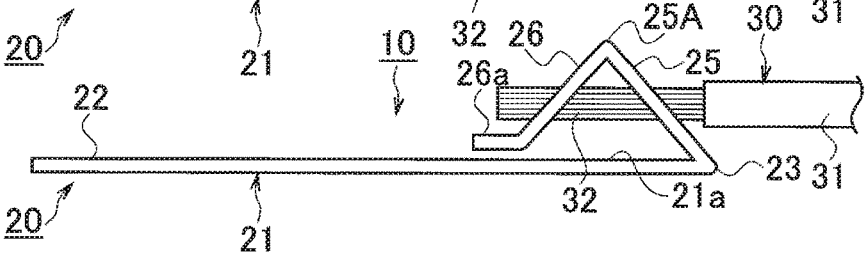
FIG. 2B is a side view of the state illustrated in FIG. 2A.
Figure 3A:
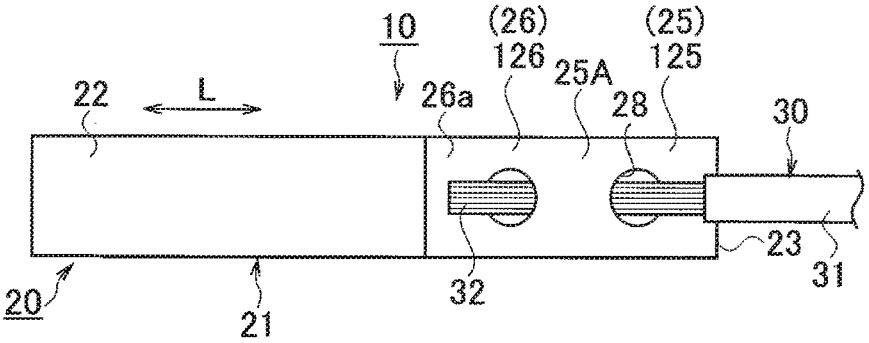
FIG. 3A is a plan view illustrating a state that the electric-wire is connected to the terminal of the connection structure of the electric-wire and the terminal according to the first embodiment.

FIG. 1A is a plan view illustrating a terminal for a connection structure of an electric-wire and the terminal according to a first embodiment before connected to the electric-wire; FIG. 1B is a side view of the state illustrated in FIG. 1A; FIG. 2A is a plan view illustrating a state that the electric-wire being arranged to the terminal; FIG. 2B is a side view of the state illustrated in FIG. 2A; FIG. 3A is a plan view illustrating a state that the electric-wire is connected to the terminal; and FIG. 3B is a side view of the state illustrated in FIG. 3A.

As illustrated in FIGS. 2A-3B, the connection structure of the electric-wire and the terminal 10 includes a terminal 20 and an electric-wire 30. The terminal 20 is formed by folding back a conductive bottom plate (base plate) 21. A folded part of the bottom plate 21 is an elastic connection piece (spring piece) 25, 26 continuing to a folded-back portion 23 of the bottom plate 21. The elastic connection piece 25, 26 includes a first elastic connection part 25 arranged adjacent to the folded-back portion 23 and a second elastic connection part 26 continuing to the first elastic connection part 25, as a pair. The first elastic connection part 25 and the second elastic connection part 26 are arranged along a longitudinal direction of the bottom plate 21 and an electric-wire insertion hole 28 is formed on each of the first elastic connection part 25 and the second elastic connection part 26. The elastic connection piece 25, 26 is inclined with respect to the body part of the bottom plate 21 (other part of the bottom plate 21) in a state before connecting to the electric wire 30. The second elastic connection part 26 is inclined so as to face the first elastic connection part 25 in the longitudinal direction of the base plate. The electric-wire 30 includes a core wire 32 with extra-fine strands being exposed from an insulation sheath 31. The electric-wire 30 is connected to the terminal 20 by inserting the core wire 32 with extra-fine strands exposed from the insulation sheath through each electric-wire insertion holes 28 of the elastic connection piece 25, 26 and by applying pressure to the elastic connection piece 25, 26 and collapsing the elastic connection piece 25, 26 into a flat surface, and consequently, the core wire 32 being in contact with the upper surface 21*a* of the bottom plate 21.

As illustrated in FIGS. 1A to 2B, the bottom plate 21 of the terminal 20 is made of metal and formed in a rectangular plate shape. The bottom plate 21 includes a terminal connection portion 22 to which a mating terminal (not shown) is connected on the front side. In a state before connecting the terminal 20 to the electric-wire 30, the first elastic connection part 25 and the second elastic connection part 26, which are the parts inclined at a predetermined angle from the folded-back portion 23 on the base end side of the bottom plate 21, are bent and formed so as to face each other to form a mountain shape. Round electric-wire insertion hole 28 is formed at a center of the first elastic connection part 25 and at a center of the second elastic connection part 26.

Figure 3B:
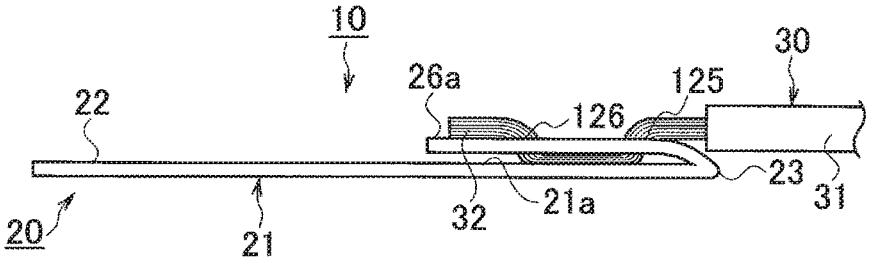
FIG. 3B is a side view of the state illustrated in FIG. 3A.

As illustrated in FIGS. 3A and 3B, the core wire 32 exposed from the insulation sheath 31 of the electric-wire 30 is inserted through each electric-wire insertion hole 28 formed on the first elastic connection part 25 and the second elastic connection part 26. In a state the core wire 32 exposed from the insulation sheath 31 is inserted through the electric-wire insertion holes 28, pressure is applied to a top portion 25A of the mountain-shaped elastic connection piece 25, 26 and the core wire 32 exposed from the insulation sheath 31 is sandwiched and connected between the upper surface of the bottom plate 21 and the elastic connection part 125, 126 being collapsed (having a flattened plate-like shape formed by the pressure).

A straight part 26*a* parallel to the upper surface 21*a* at the body part of the bottom plate 21 is bent and formed at a tip of the second elastic connection part 26. After the top portion 25A of the mountain-shaped elastic connection piece 25, 26 is pressed and collapsed, the elastic connection piece 125, 126 and the straight part 26*a* are in planar shape due to the applied pressure.

According to the connection structure of the electric-wire and the terminal of the first embodiment, the terminal and the electric-wire can be easily and reliably connected without breaking the core wire 32 even when the core wire has extra-fine strand, since the core wire 32 exposed from the insulation sheath 31 of the electric-wire 30 is inserted through each electric-wire insertion hole 28 formed on the first elastic connection part 25 and the second elastic connection part 26; and in a state the core wire 32 exposed from the insulation sheath 31 is inserted through the electric-wire insertion holes 28, a pressure is applied to a top portion 25A of the mountain-shaped elastic connection piece 25, 26 and the core wire 32 exposed from the insulation sheath 31 is sandwiched and connected between the upper surface 21*a* of the bottom plate 21 and the elastic connection piece 125, 126 collapsed.

Further, unlike the conventional crimping terminals, the connection of the terminal 20 and the electric-wire 30 is not limited by the dimensions of the crimping die including crimper, anvil, etc., and it is possible to cope with narrow pitch connectors, since the terminal 20 is formed by opening two electric-wire insertion holes 28 on the bottom plate 21 made of one metal plate; by bending the bottom plate 21 to form the first elastic connection part 25 and the second elastic connection part 26 so that each electric-wire insertion hole 28 is arranged on the slope of the mountain-shaped elastic connection piece 25, 26; by inserting the core wire 32 exposed from the insulation sheath 31 of the electric-wire 30 through the electric-wire insertion holes 28; and by collapsing the elastic connection pieces 25, 26. In addition, since the pressure parts can be shared, cost reduction can be achieved accordingly.

Figure 4A:
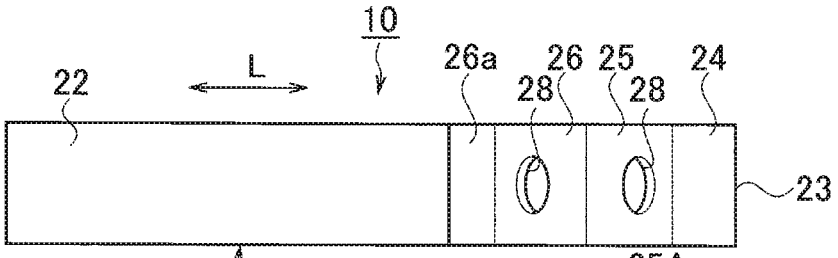
FIG. 4A is a plan view illustrating a terminal for a connection structure of an electric-wire and the terminal according to a second embodiment before connected to the electric-wire.
Figure 4B:
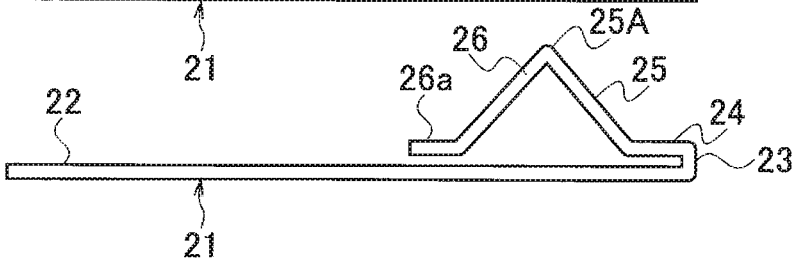
FIG. 4B is a side view of the state illustrated in FIG. 4A.
Figure 5A:
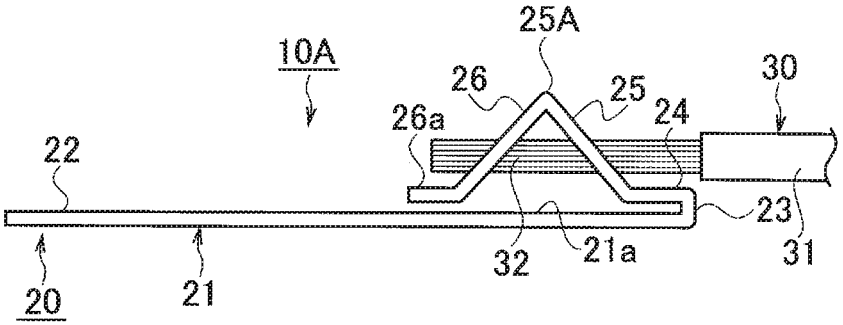
FIG. 5A is a side view illustrating a state that the electric-wire being arranged to the terminal of the connection structure of the electric-wire and the terminal according to the second embodiment.
Figure 5B:
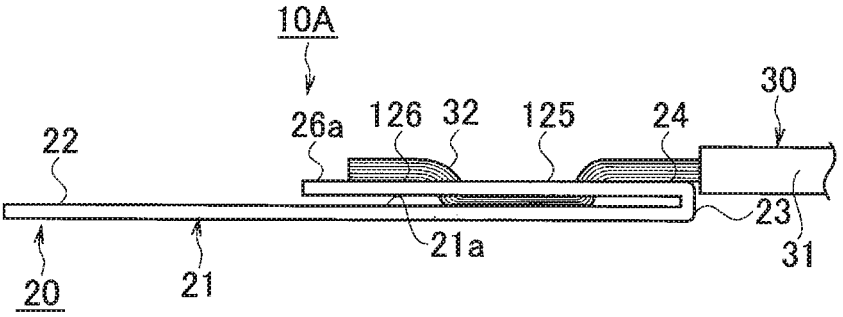
FIG. 5B is a side view illustrating a state that the electric-wire is connected to the terminal of the connection structure of the electric-wire and the terminal according to the second embodiment.

FIG. 4A is a plan view illustrating a terminal for a connection structure of an electric-wire and the terminal according to a second embodiment before connected to the electric-wire; FIG. 4B is a side view of the state illustrated in FIG. 4A; FIG. 5A is a side view illustrating a state that the electric-wire being arranged to the terminal; and FIG. 5B is a side view illustrating a state that the electric-wire is connected to the terminal.

The configurations of the second embodiment different from those of the first embodiment is that, in a connection structure 10A of an electric-wire 30 and a terminal 20A of the second embodiment, a straight part 24 is formed between a folded-back portion 23 of a bottom plate (base plate) 21 and a first elastic connection part 25 which is inclined and arranged adjacent to the folded-back portion 23. Since the other configurations are the same as that of the first embodiment, the same components are denoted with the same reference numerals and the detailed description will be omitted.

According to the connection structure 10A of the electric-wire and the terminal of the second embodiment, since the terminal 20 includes the straight part 24 formed between the folded-back portion 23 of the base plate and the first elastic connection part 25, when pressure is applied to a top portion 25A of the mountain-shaped elastic connection piece 25, 26 and the core wire 32 exposed from the insulation sheath 31 is sandwiched and connected between the upper surface of the bottom plate 21 and the elastic connection piece 125, 126 being collapsed, the core wire 32 of the electric-wire 30 can be stably contacted and connected to the straight part 24 on the folded-back portion 23 side and the straight part 26*a* on the tip side of the second elastic connection part 26. Accordingly, the terminal 20 and the electric-wire 30 can be easily and securely connected to the upper surface 21*a* of the bottom plate 21 without breaking the extra-fine strands for the core wire 32 of the electric-wire 30.

Figure 6A:
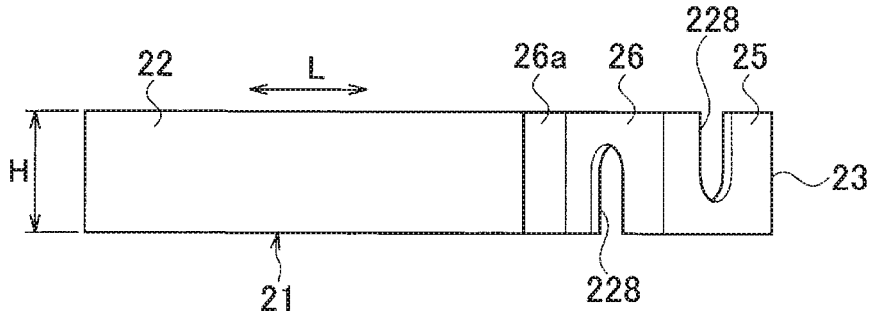
FIG. 6A is a plan view illustrating a terminal for a connection structure of an electric-wire and the terminal according to a third embodiment before connected to the electric-wire.
Figure 6B:
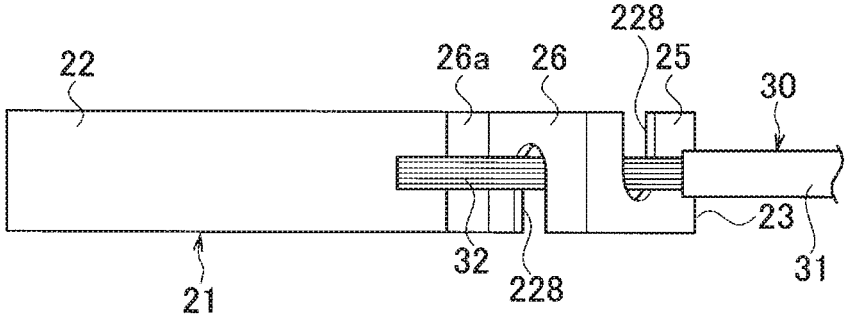
FIG. 6B is a plan view illustrating a state that the electric-wire being arranged to the terminal of the connection structure of the electric-wire and the terminal according to the third embodiment.
Figure 7A:
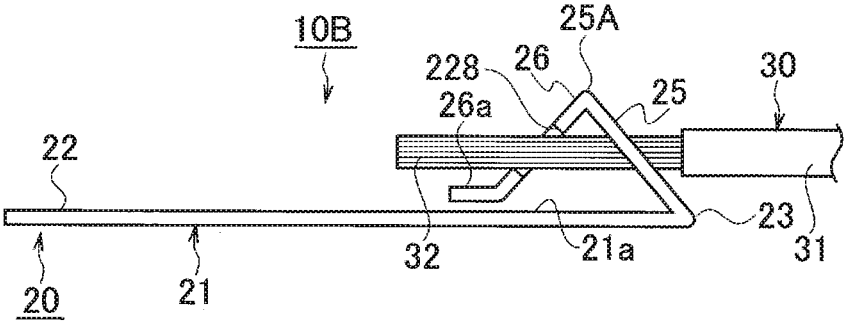
FIG. 7A is a side view illustrating a state that the electric-wire being arranged to the terminal of the connection structure of the electric-wire and the terminal according to the third embodiment.
Figure 7B:
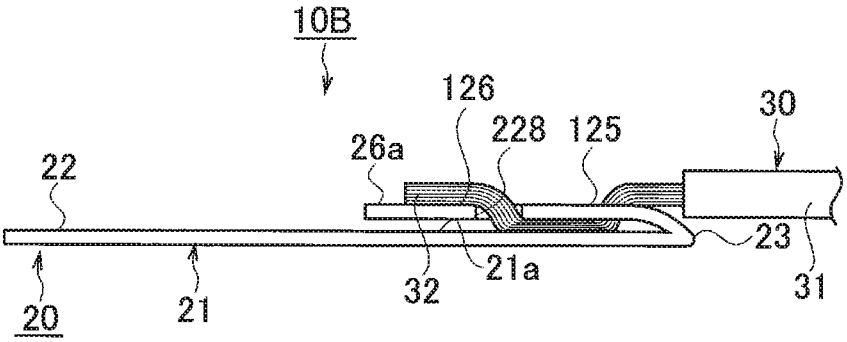
FIG. 7B is a side view illustrating a state that the electric-wire is connected to the terminal of the connection structure of the electric-wire and the terminal according to the third embodiment.

FIG. 6A is a plan view illustrating a terminal for a connection structure of an electric-wire and the terminal according to a third embodiment before connected to the electric-wire; FIG. 6B is a plan view illustrating a state that the electric-wire being arranged to the terminal; FIG. 7A is a side view illustrating a state that the electric-wire being arranged to the terminal; and FIG. 7B is a side view illustrating a state that the electric-wire is connected to the terminal.

The configurations of the third embodiment different from those of the first embodiment is that, in a connection structure 10B of an electric-wire 30 and a terminal 20A of the third embodiment, each electric-wire insertion hole 228 formed on the mountain-shaped elastic connection piece 25, 26 of the bottom plate 21 is formed into an oblong shape which is alternately opened from the width direction H of the bottom plate 21 and penetrating the bottom plate 21. Since the other configurations are the same as that of the first embodiment, the same components are denoted with the same reference numerals and the detailed description will be omitted.

According to the connection structure 10B of the electric-wire and the terminal of the second embodiment, since the electric-wire insertion holes 228 formed on the mountain-shaped elastic connection piece 25, 26 are alternately opened from the width direction H of the bottom plate 21 and penetrating the bottom plate 21, the core wire 32 exposed from the insulation sheath 31 of the electric-wire 30 is easily and reliably inserted into each electric-wire insertion holes 228. Accordingly, the terminal 20 and the electric-wire 30 can be easily and securely connected to the upper surface 21*a* of the bottom plate 21 without breaking the extra-fine strands for the core wire 32 of the electric-wire 30.

Figure 8A:
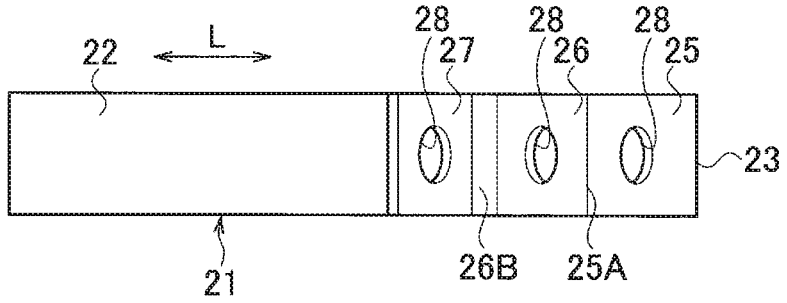
FIG. 8A is a plan view illustrating a terminal for a connection structure of an electric-wire and the terminal according to a fourth embodiment before connected to the electric-wire.
Figure 8B:
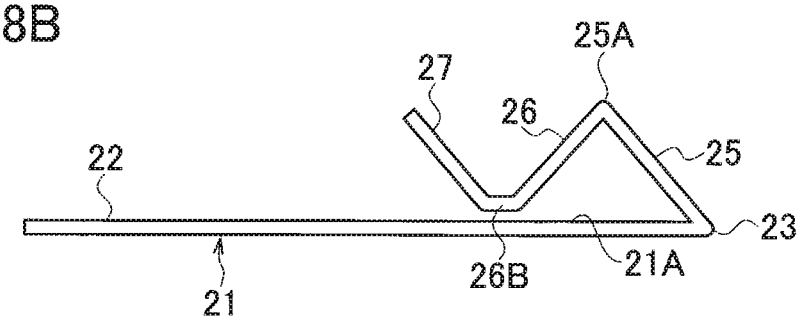
FIG. 8B is a side view of the state illustrated in FIG. 8A.
Figure 9A:
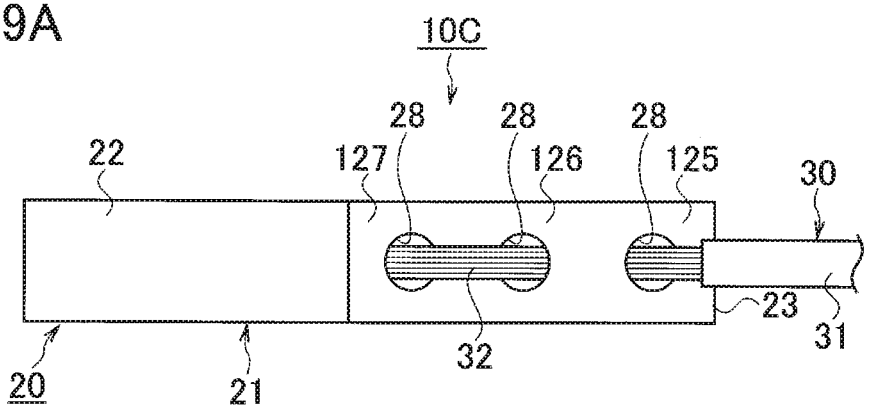
FIG. 9A is a plan view illustrating a state that the electric-wire being arranged to the terminal of the connection structure of the electric-wire and the terminal according to the fourth embodiment.
Figure 9B:
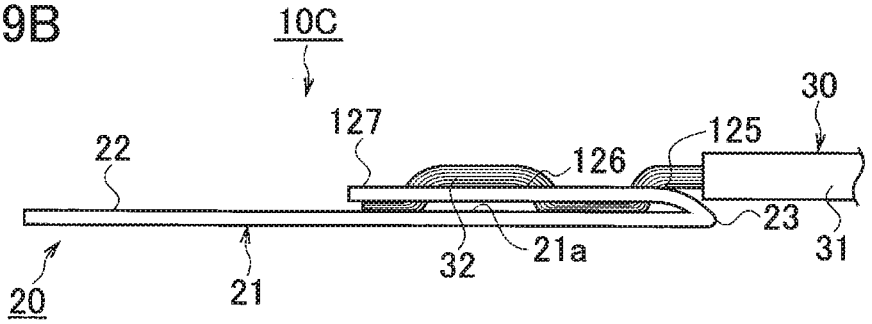
FIG. 9B is a side view illustrating a state that the electric-wire is connected to the terminal of the connection structure of the electric-wire and the terminal according to the fourth embodiment.

FIG. 8A is a plan view illustrating a terminal for a connection structure of an electric-wire and the terminal according to a fourth embodiment before connected to the electric-wire; FIG. 8B is a side view of the state illustrated in FIG. 8A; FIG. 9A is a plan view illustrating a state that the electric-wire being arranged to the terminal; and FIG. 9B is a side view illustrating a state that the electric-wire is connected to the terminal.

The configurations of the fourth embodiment different from those of the first embodiment is that, in a connection structure 10C of the electric-wire 30 and the terminal 20, a terminal 20 before pressed and connected to the electric-wire 30 includes the mountain-shaped elastic connection piece 25, 26 of the bottom plate 21, and further includes a third elastic connection part 27 inclined at the same angle as the first elastic connection part 25 arranged on the folded-back portion 23 side and formed by further bending the tip bottom end 26B side of the inclined second elastic connection part 26 of the mountain-shaped elastic connection piece 25, 26, the second elastic connection part 26 arranged on the opposite side of the folded-back portion 23; electric-wire insertion hole 28 is formed on the third elastic connection part 27 as in the case with the first and second elastic connection part 25 and 26; and the core wire 32 exposed from the insulation sheath 31 of the electric-wire 30 is further held and connected at a tip part 32*a* by the third elastic connection part 127 and the body part of the bottom plate 21 at a state where the core wire 32 exposed from the insulation sheath 31 is inserted through the wire insertion holes 28 formed on the first elastic connection part 25, second elastic connection part 26, and third elastic connection part 27 in the longitudinal direction L of the bottom plate 21 and, the state being achieved by pressing the first elastic connection part 25, the second elastic connection part 26, and the third elastic connection part 27 from the top portion 25A side to be a collapsed elastic connection parts

125, 126 and 127, respectively. Since the other configurations are the same as that of the first embodiment, the same components are denoted with the same reference numerals and the detailed description will be omitted.

The connection structure 10C of the electric-wire and the terminal of the fourth embodiment can reliably prevent the tip 32*a* side of the core wire 32 from curling up, since the core wire 32 exposed from the insulation sheath 31 of the electric wire 30 is further held and connected at a tip part 32*a* by the collapsed third elastic connection part 127 and the body part of the bottom plate 21 in a state after the mountain-shaped elastic connection piece 25, 26, 27 being pressed from the top portion 25A side and accordingly the third elastic connection part 27 bent and formed on the tip bottom end 26*b* are flatly collapsed.

FIGS. 10A, 10C, 10E, and 10G are variations of the terminals used in the first to fourth embodiments, partial plan views illustrating a part of terminal facing to an elastic connection part of the terminal; and FIGS. 10B, 10D, 10F, and 10H are cross sectional views of FIGS. 10A, 10C, 10E, and 10G, respectively.

The upper surfaces 21*a* for the body part of the bottom plates 21 in the terminals 20 used in the first to fourth embodiments are formed in flat surfaces facing the respective elastic connection pieces 25, 26 (or elastic connection piece 25, 26, 27 in fourth embodiment). However, as illustrated in FIGS. 10A to 10H, serrations (recesses or protrusions) 29 may be formed at a part of the bottom plate 21 to be in contact with the core wire 32 exposed from the insulation sheath 31 of the electric-wire 30.

Figure 10A:
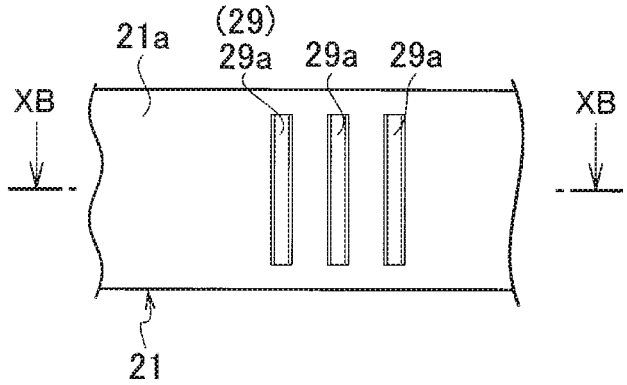
FIG. 10A is a variation of the terminals used in the first to fourth embodiments, a partial plan view illustrating a part of terminal facing to an elastic connection part of the terminal.
Figure 10B:
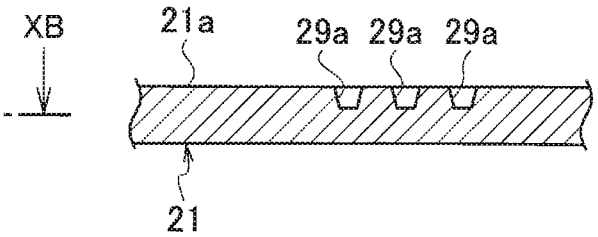
FIG. 10B is a cross sectional view along XB-XB line illustrated in FIG. 10A.
Figure 10C:
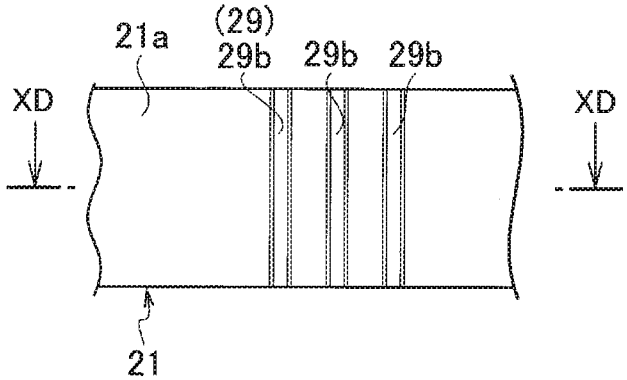
FIG. 10C is another variation of the terminals used in the first to fourth embodiments, a partial plan view illustrating apart of terminal facing to an elastic connection part of the terminal.
Figure 10D:
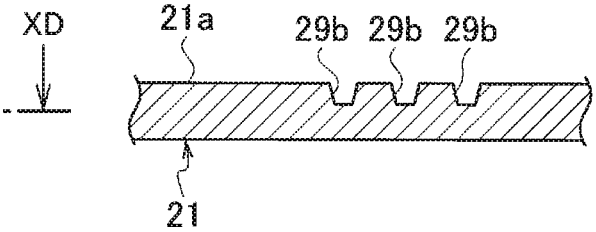
FIG. 10D is a cross sectional view along XD-XD line illustrated in FIG. 10C.
Figure 10E:
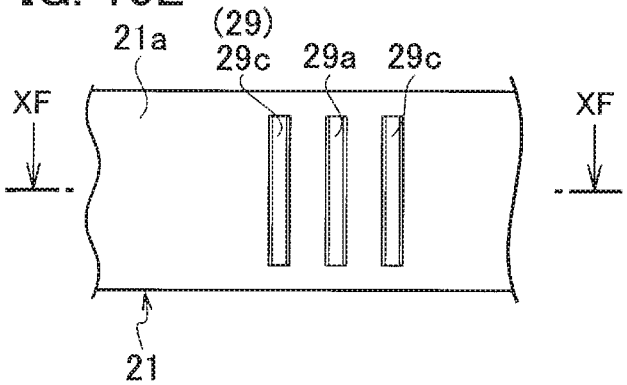
FIG. 10E is another variation of the terminals used in the first to fourth embodiments, a partial plan view illustrating apart of terminal facing to an elastic connection part of the terminal.
Figure 10F:
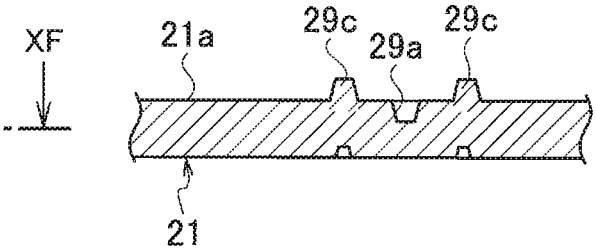
FIG. 10F is a cross sectional view along XF-XF line illustrated in FIG. 10E.
Figure 10G:
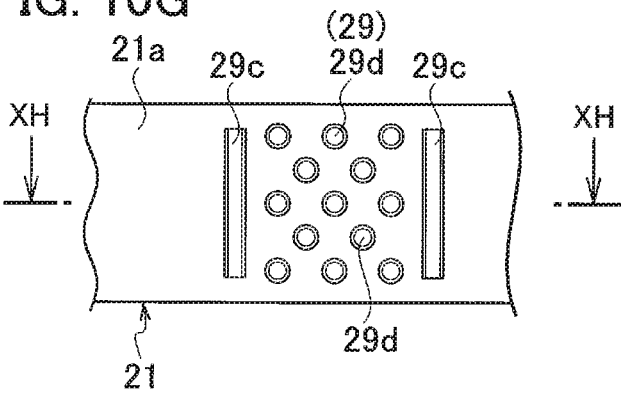
FIG. 10G is another variation of the terminals used in the first to fourth embodiments, a partial plan view illustrating apart of terminal facing to an elastic connection part of the terminal.
Figure 10H:
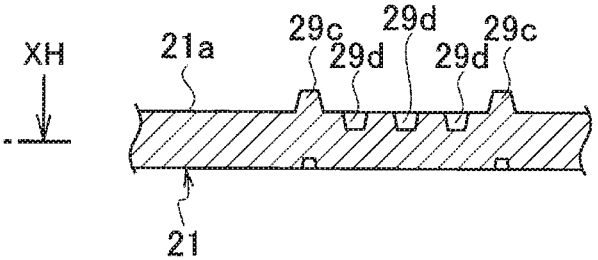
FIG. 10H is a cross sectional view along XH-XH line illustrated in FIG. 10G.

As illustrated in FIGS. 10A and 10B, three recesses 29*a* parallel to each other may be formed at the center of the bottom plate 21. As illustrated in FIGS. 10C and 10D, three recesses 29*b* may be formed at the center of the bottom plate 21 so as the both ends to be opened. As illustrated in FIGS. 10E and 10F, two protrusions 29*c* and a recess 29*a* arranged between the protrusions 29*c* may be formed at the center of the bottom plate 21. As illustrated in FIGS. 10G and 10H, two protrusions 29*c* and a plurality of round recesses 29*d* formed between the protrusions 29*c* may be formed at the center of the bottom plate 21.

In each of the above embodiments, the elastic connection piece having the electric-wire insertion hole in each elastic connection parts may be formed to be bent to four or more.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connection structure of an electric-wire and a terminal comprising:

a terminal with a base plate, the base plate including a body part and an elastic connection piece formed by folding back the base plate in the longitudinal direction of the base plate, and an electric-wire having a core wire exposed from an insulation sheath, wherein the elastic connection piece of the terminal includes a first elastic connection part adjacent to a folded-back portion of the base plate at one end and inclined toward the other end with respect to the body part of the base plate, and a second elastic connection part continuing to the first elastic connection part at one end and inclined toward the other end so as to face the first elastic connection part in the longitudinal direction of the base plate, wherein a first wire insertion hole is formed on the first elastic connection part and a second wire insertion hole is formed on the second elastic connection part, wherein the core wire exposed from the insulation sheath is sandwiched by the elastic connection piece and the body part and connected to the terminal at a position between the first elastic connection part and the second elastic connection part at a state where the core wire exposed from the insulation sheath is inserted through the first wire insertion hole and the second wire insertion hole in the longitudinal direction of the base plate, and the connection structure being formed by pressing the first elastic connection part and the second elastic connection part in a direction reducing the inclination of both the first elastic connection part and the second elastic connection part with respect to the base plate.

2. The connection structure of the electric-wire and the terminal according to claim 1, wherein the elastic connection piece of the terminal before being pressed further comprises a third elastic connection part continuing to the other end of the second elastic connection part at one end and inclined toward the other end with respect to the body part of the base plate at an inclination angle same as that of the first elastic connection part, wherein a third wire insertion hole is formed on the third elastic connection part, wherein the core wire exposed from the insulation sheath of the electric wire is further held and connected at a tip part by the third elastic connection part and the body part of the base plate at a state where the core wire exposed from the insulation sheath of the electric wire is inserted through the first wire insertion hole, the second wire insertion hole, and the third insertion hole in the longitudinal direction of the base plate and, the state being achieved by pressing the first elastic connection part, the second elastic connection part, and the third elastic connection part in a direction to reduce the inclination of the first elastic connection part, the second elastic connection part, and the third connection part with respect to the body part of the base plate.

3. The connection structure of the electric wire and the terminal according to claim 1, wherein the first wire insertion hole and the second wire insertion hole have an oblong shape opened in the width direction of the base plate and penetrated.

4. The connection structure of the electric wire and the terminal according to claim 1, wherein at least one of a recess or a protrusion is formed at a part on the base plate where the core wire exposed from the insulation sheath of the electric wire contacts with the base plate.

5. The connection structure of the electric wire and the terminal according to claim 1, wherein the terminal further comprises a straight part formed between the folded-back portion of the base plate and the elastic connection piece, the elastic connection piece being inclined with respect to the body part of the base plate.

* * * * *